US011811153B2

(12) United States Patent
Yamauchi

(10) Patent No.: US 11,811,153 B2
(45) Date of Patent: Nov. 7, 2023

(54) WIRELESS MODULE

(71) Applicant: LAPIS Technology Co., Ltd., Yokohama (JP)

(72) Inventor: Shigeki Yamauchi, Yokohama (JP)

(73) Assignee: LAPIS TECHNOLOGY CO., LTD., Yokohama (JP)

( * ) Notice: Subject to any disclaimer, the term of this patent is extended or adjusted under 35 U.S.C. 154(b) by 22 days.

(21) Appl. No.: 17/545,745

(22) Filed: Dec. 8, 2021

(65) Prior Publication Data

US 2022/0181782 A1 Jun. 9, 2022

(30) Foreign Application Priority Data

Dec. 8, 2020 (JP) ..... 2020-203361

(51) Int. Cl.
*H01Q 1/22* (2006.01)
*H01Q 1/24* (2006.01)
*H01Q 9/04* (2006.01)

(52) U.S. Cl.
CPC ..... *H01Q 9/0421* (2013.01); *H01Q 1/2283* (2013.01); *H01Q 1/243* (2013.01)

(58) Field of Classification Search
CPC ..... H01Q 1/24; H01Q 1/243; H01Q 1/22; H01Q 1/2283; H01Q 9/04; H01Q 9/0421; H01Q 7/00
See application file for complete search history.

(56) References Cited

U.S. PATENT DOCUMENTS 7,728,785 B2 * 6/2010 Ozden ..... H01Q 9/0421 343/866
2012/0105303 A1 * 5/2012 Kusanagi ..... H01Q 9/0421 343/905
2013/0207861 A1 * 8/2013 Huang ..... H01Q 1/2266 343/700 MS
2015/0207229 A1 * 7/2015 Chiang ..... H01Q 1/50 343/866
2019/0089047 A1 * 3/2019 Hara ..... H01Q 21/22

FOREIGN PATENT DOCUMENTS

JP 2002-158529 A 5/2002

* cited by examiner

*Primary Examiner* — Thai Pham
(74) *Attorney, Agent, or Firm* — Rabin & Berdo, P.C.

(57) ABSTRACT

A wireless module has a multilayer substrate, an element installation section formed in one region in a substrate plane of the multilayer substrate, and an antenna. The antenna includes a conductor unit formed in another region in the substrate plane of the multilayer substrate. The conductor unit has a first end and a second end that extend along an outer periphery of the other region and that are separated from each other in a direction of the extension, and is formed in a loop as seen from a direction perpendicular to a substrate surface of the multilayer substrate. A feed unit connected to the first end of the conductor unit receives input of an AC signal of a prescribed frequency. A short-circuit line has a first end connected to a ground and a second end connected to the conductor unit through the feed unit.

7 Claims, 6 Drawing Sheets

WIRELESS MODULE

CROSS REFERENCE TO RELATED APPLICATION

This application is based upon and claims the benefit of priority of the prior Japanese Patent Application No. 2020-203361, filed on Dec. 8, 2020, the entire contents of which are incorporated herein by reference.

TECHNICAL FIELD

The present invention relates to a wireless module equipped with an antenna.

BACKGROUND ART

There are currently many types of wireless communication devices that use IoT (Internet of Things) technology in development. Additionally, wireless communication devices are starting to be used in industries that until now have not used wireless communication devices.

In using wireless communication functions, it is necessary to obtain wireless certifications compatible with standards and regulations established by each country. In order to obtain wireless certifications, it is necessary to have familiarity with wireless communication technology, which poses an obstacle to market growth.

As a means for solving this problem, wireless modules for which wireless certifications have been obtained in advance are used. This is because if a wireless module for which wireless certifications have been obtained is installed in a device, there is no need to additionally obtain wireless certifications for the device.

Antenna-equipped wireless modules are known examples of such wireless modules. The antenna installed in a wireless module is often constituted of a chip antenna or a substrate pattern antenna. Also, substrate pattern antennas often have a meandered inverted-F antenna type structure in order to arrange a monopole antenna in a small antenna area.

Also, as an antenna used in communication equipment, an antenna having a structure in which an open end section of a loop-shaped radiation electrode is disposed at a position close to a feed electrode provided on a second end and a capacitance is formed between the open end section and the feed electrode is proposed (e.g., Japanese Patent Application Laid-Open Publication No. 2002-158529).

SUMMARY OF THE INVENTION

In recent years, amid size reductions in devices equipped with wireless modules, there is also increased need for wireless modules of reduced size. However, if the antenna area of the wireless module is reduced, this poses problems such as attenuation of gain, among the antenna characteristics, and a narrowed frequency band where excellent impedance can be attained.

In a substrate pattern antenna installed on a conventional wireless module, for example, as the antenna area is reduced, it is not possible to form the necessary wiring length for the antenna length, resulting in greater gain attenuation, among the antenna characteristics. Even in the case of an ideal radiation pattern of a monopole antenna, there is a direction in which the antenna gain is low, the antenna gain in directions close to that direction is further attenuated, and communication connection is difficult. Also, in a chip antenna installed in a wireless module, the components are somewhat expensive, which results in increased cost for the wireless module itself.

An object of the present invention is to provide a wireless module having an antenna with a small antenna area and a high radiation efficiency.

A wireless module according to the present invention includes: a multilayer substrate; an element installation section formed in one region in a substrate plane of the multilayer substrate; and an antenna including: a conductor unit that is formed in another region in the substrate plane of the multilayer substrate, that has a first end and a second end that extend along an outer periphery of said other region and that are separated from each other in a direction of said extension, and that is formed in a loop as seen from a direction perpendicular to a substrate surface of the multilayer substrate; a feed unit that is connected to the first end of the conductor unit and is configured to receive input of an AC signal of a prescribed frequency; and a short-circuit line having a first end connected to a ground and a second end connected to the conductor unit through the feed unit.

Also, a wireless module according to the present invention includes: a multilayer substrate; a communication circuit formed in an element installation region in a substrate plane of the multilayer substrate; and an antenna including: a conductor unit that is formed in another region of the multilayer substrate, that has a first end and a second end that extend along an outer periphery of said other region and that are separated from each other in a direction of said extension, and that is formed in a loop as seen from a direction perpendicular to a substrate surface of the multilayer substrate; a feed unit that is connected to the first end of the conductor unit and is configured to receive input of an AC signal of a prescribed frequency from the communication circuit; and a short-circuit line having a first end connected to a ground and a second end connected to the conductor unit through the feed unit.

According to the wireless module of the present invention, it is possible to attain a high radiation efficiency while suppressing the antenna area.

DETAILED DESCRIPTION OF EMBODIMENTS

Figure 1:
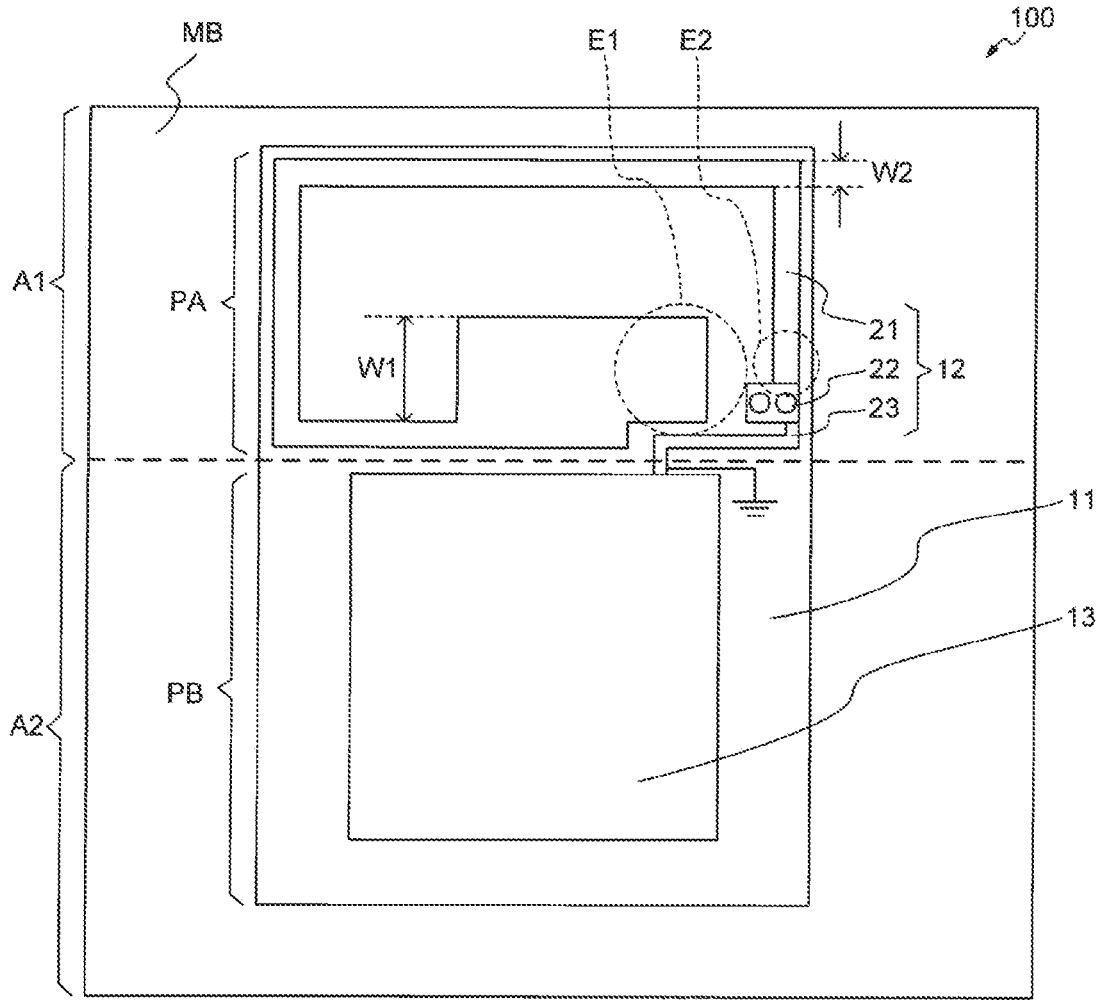
FIG. 1 is a top view showing a configuration of a wireless module according to Embodiment 1 of the present invention.

Suitable embodiments of the present invention will be explained below in detail. In the description of embodiments and the affixed drawings below, parts that are substantially the same or equivalent to each other are assigned the same reference characters.

Embodiment 1

FIG. 1 is a top view of a wireless module 100 according to the present embodiment, as seen from above the first surface (hereinafter simply referred to as the "surface") of the substrate where the wireless module 100 is installed. The wireless module 100 includes a multilayer substrate 11, and an antenna 12 and a circuit unit 13 that are formed on the multilayer substrate 11.

The multilayer substrate 11 is a multiple-layer substrate in which a plurality of layers are stacked so as to sandwich dielectric layers. The multilayer substrate 11 has a rectangular shape in a top view and is provided on a motherboard MB.

Figure 2:
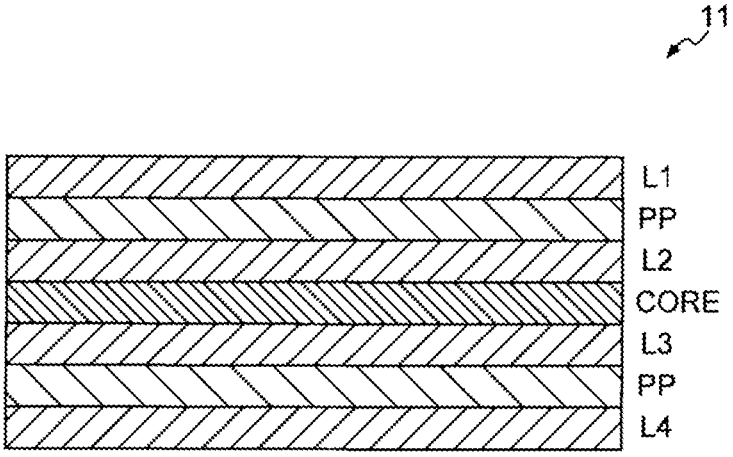
FIG. 2 schematically shows an example of a layer structure of a multilayer substrate of the present embodiment.

FIG. 2 is a cross-sectional view that schematically shows a layer structure of the multilayer substrate 11. The multilayer substrate 11 of the present embodiment is a rigid substrate with a four-layer structure, for example, and includes an L1 layer, an L2 layer, an L3 layer, an L4 layer, and a core layer (CORE). PP layers are formed between the L1 layer and the L2 layer, and between the L3 layer and the L4 layer.

The L1 layer is a conductive layer (first conductive layer) constituting the first layer of the four-layer structure. The L2 layer is a conductive layer (second conductive layer) constituting the second layer of the four-layer structure. The L3 layer is a conductive layer (third conductive layer) constituting the third layer of the four-layer structure. The L4 layer is a conductive layer (fourth conductive layer) constituting the fourth layer of the four-layer structure. The L1 layer to the L4 layers are configured as signal layers (wiring layers) made of copper foil (Cu), for example.

The PP layers are dielectric layers provided between the wiring layers, and are constituted of a prepreg made of epoxy resin or the like. The core layer is an inner layer positioned at the center of the multiple-layer substrate, and is provided between the L2 layer and the L3 layer in the present embodiment. The core layer is made of a base material formed by curing an epoxy resin or the like.

Returning to FIG. 1, the multilayer substrate 11 has an antenna disposal region PA in which the antenna is disposed, and an element installation region PB in which an element constituting the circuit unit is installed within the plane of the substrate (that is, within the plane in the direction orthogonal to the layering direction). The antenna disposal region PA is arranged in a first region A1 of the motherboard MB and the element installation region PB is arranged in a second region A2 of the motherboard MB.

The antenna 12 of the wireless module 100 is constituted of a conductor unit 21, a feed port 22, and a short-circuit line 23. The antenna 12 is provided in the antenna disposal region PA of the multilayer substrate 11. The circuit unit 13 includes a wireless communication circuit that transmits and receives wireless signals, and is constituted of a plurality of elements installed in the element installation region PB.

The conductor unit 21 of the antenna 12 is constituted of a belt-shaped conductor that extends in a loop along the outer periphery of the antenna disposal region PA in a top view (that is, a view from the direction perpendicular to the substrate surface of the multilayer substrate 11). The loop has formed therein an open end section constituted of a first end and a second end that are separated along the extension direction.

In the present embodiment, the conductor unit 21 has a rectangular loop shape, and the open end section is provided on one side facing the element installation region PB. A first end E2 of the conductor unit 21 constituting the open end section is connected to the feed port 22. A second end E1 of the conductor unit 21 is positioned close to the center of the loop, and has a line width W1 greater than a line width W2 of another conductor section including the first end E2.

The feed port 22 is a feed point at which input of a signal in a prescribed frequency band is received. The feed port 22 is provided at a position close to the open end section of the loop formed by the conductor unit 21 (e.g., the side adjacent to the side having the open end section of the rectangular shape formed by the conductor unit 21), and is connected to the first end E2 of the conductor unit 21.

The short-circuit line 23 is a wiring section that connects the conductor unit 21 to a ground pattern (not shown) of the motherboard MB. The first end of the short-circuit line 23 is connected to the ground pattern. The second end of the short-circuit line 23 is connected to the first end E2 of the conductor unit 21 via the feed port 22.

In the present embodiment, the conductor unit 21 and the short-circuit line 23 are respectively formed in the L2 layer, which is the second conductive layer.

The antenna 12 is configured as an inverted-F antenna constituted of the conductor unit 21, the feed port 22, and the short-circuit line 23. Also, the conductor unit 21 is configured as a split ring having the open end section. That is, the antenna 12 of the present embodiment has an antenna structure that combines the inverted-F antenna and a loop antenna constituted of a split-ring resonator.

Figure 3A:
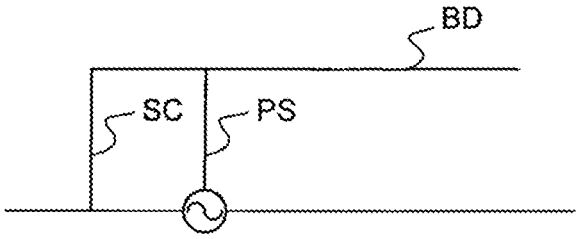
FIG. 3A schematically shows a configuration of a typical inverted-F antenna.

FIG. 3A schematically shows a configuration of a typical inverted-F antenna. The conductor unit 21 of the antenna 12 of the present embodiment corresponds to the main body portion BD of the inverted-F antenna. The feed port 22 and the short-circuit line 23 of the antenna 12 correspond, respectively, to a feed line PS and a short-circuit line SC of the inverted-F antenna.

Figure 3B:
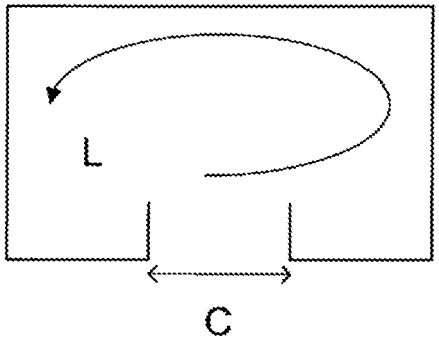
FIG. 3B is a circuit diagram that schematically shows a configuration of a split-ring resonator.

FIG. 3B is a circuit diagram that schematically shows a configuration of a split-ring resonator. The conductor unit 21 of the antenna 12 of the present embodiment has the role of an inductor L of the split-ring resonator. A capacitance C is changed by adjusting the line width W1 of the second end of the conductor unit 21 shown in FIG. 1. That is, in the antenna 12 of the present embodiment, by forming a split ring with the loop-shaped conductor unit 21 and forming the capacitance C in the open end section, an LC series resonance circuit is configured. A resonant frequency f is represented by the following formula (formula 1) using L and C.

$$f = \frac{1}{2\pi\sqrt{LC}} \quad \text{[Formula 1]}$$

The inverted-F antenna is an electric field antenna that generates a current through a change in the electric field. By contrast, the loop antenna (split-ring resonator) is a magnetic field antenna that generates a current through a change in the magnetic field.

The inverted-F antenna, being an electric field antenna, has a high degree of sensitivity in the axial direction of the antenna (that is, the extension direction of the conductor unit). On the other hand, the loop antenna, being a magnetic field antenna, has a high degree of sensitivity in the direction orthogonal to the loop surface.

Figure 3C:
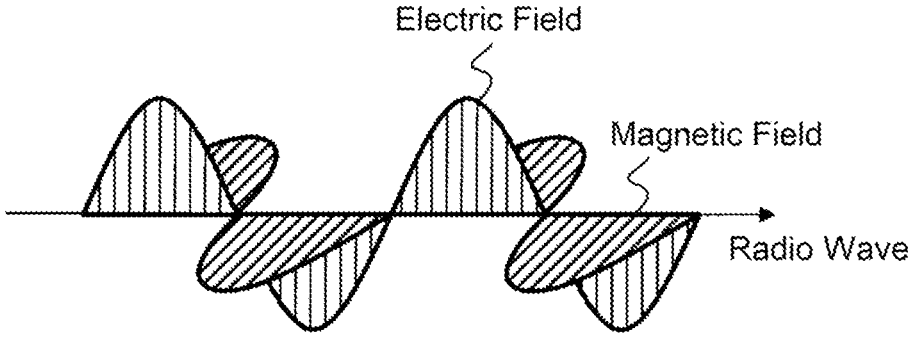
FIG. 3C shows the direction of polarized waves of an electric field and a magnetic field.

FIG. 3C shows the direction of polarized waves of an electric field and a magnetic field. The electric field and the magnetic field are polarized in directions 90 degrees from each other. For example, if the direction of the polarized wave of the electric field were the vertical direction, the direction of the polarized wave of the magnetic field would be the horizontal direction.

As described above, the antenna 12 of the present embodiment has properties of both the inverted-F antenna, which is an electric field antenna, and the loop antenna, which is a magnetic field antenna. Thus, by achieving a configuration in which the resonant frequency of the inverted-F antenna and the resonant frequency of the split-ring resonator are the same frequency (e.g., 2.4 GHz), a radiation pattern that is close to spherical in all directions can be attained.

In the present embodiment, by inputting an AC signal at a prescribed frequency band (e.g., 2.4 GHz in the present embodiment) to the terminal of the feed port 22, the AC signal is converted from a current to an electric field and a magnetic field and the signal is radiated.

Figure 4:
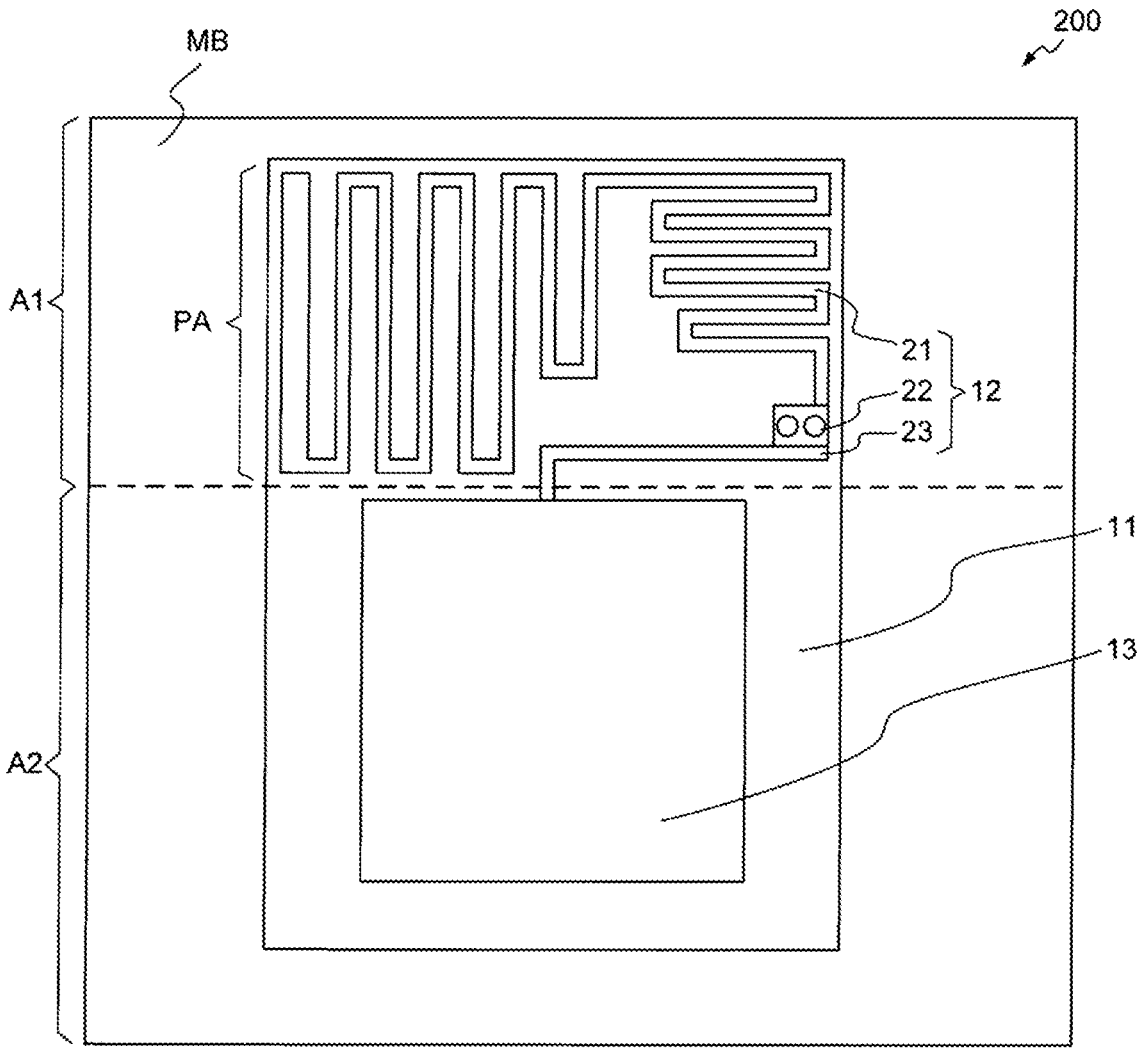
FIG. 4 is a top view showing a configuration of a wireless module according to a comparison example.

FIG. 4 shows a configuration of a wireless module of a comparison example in which the antenna section is a meandered inverted-F antenna, unlike the present embodiment.

In a wireless module 200 of the comparison example, an antenna 12 is configured as an inverted-F antenna, and does not have the properties of the loop antenna like the antenna 12 of the wireless module 100 of the present embodiment.

Figure 5A:
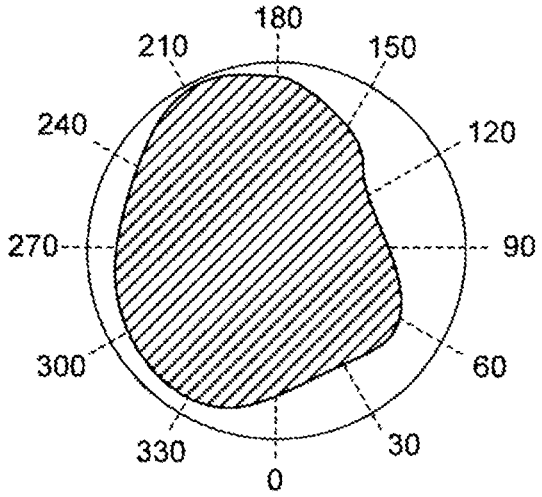
FIG. 5A shows a radiation pattern of an antenna of the wireless module according to the comparison example.

FIG. 5A shows a radiation pattern combining vertically polarized waves and horizontally polarized waves of the antenna of the wireless module 200 of the comparison example. In the wireless module 200 of the comparison example, the antenna 12 is configured as an inverted-F antenna, which is an electric field antenna, and therefore has a high sensitivity in one direction (the vertical direction of FIG. 3C, for example). The sensitivity of the antenna is reduced in a direction orthogonal to the direction with the high sensitivity (the horizontal direction of FIG. 3C, for example).

Figure 5B:
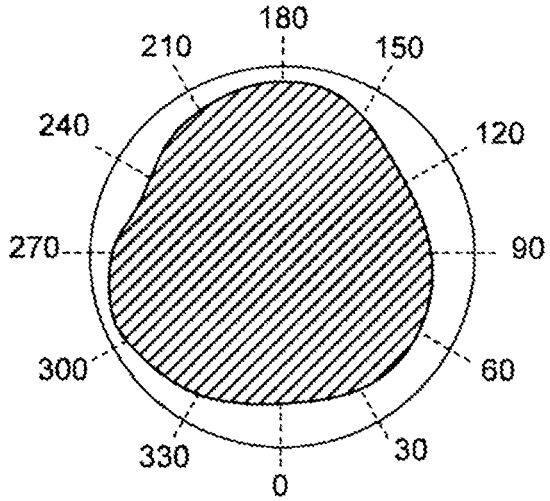
FIG. 5B shows a radiation pattern of an antenna of the wireless module according to the present embodiment.

FIG. 5B shows a radiation pattern of an antenna of the wireless module 100 according to the present embodiment. In the wireless module 100 of the present embodiment, the antenna 12 is configured as both the inverted-F antenna, which is an electric field antenna, and the loop antenna, which is a magnetic field antenna. Thus, the antenna 12 has relatively uniform radiation characteristics in both the vertical direction and the horizontal direction. Thus, as shown in FIG. 5B, the radiation pattern of the antenna has directivity characteristics close to isotropic.

As described above, the wireless module 100 of the present embodiment has the characteristics of both the inverted-F antenna, which is an electric field antenna, and the loop antenna, which is a magnetic field antenna, and thus, the antenna has a wide radiation direction. Therefore, according to the wireless module 100 of the present embodiment, it is possible to improve the radiation efficiency and directivity characteristics without increasing the antenna area (antenna disposal region PA).

Embodiment 2

Next, Embodiment 2 of the present invention will be explained.

Figure 6:
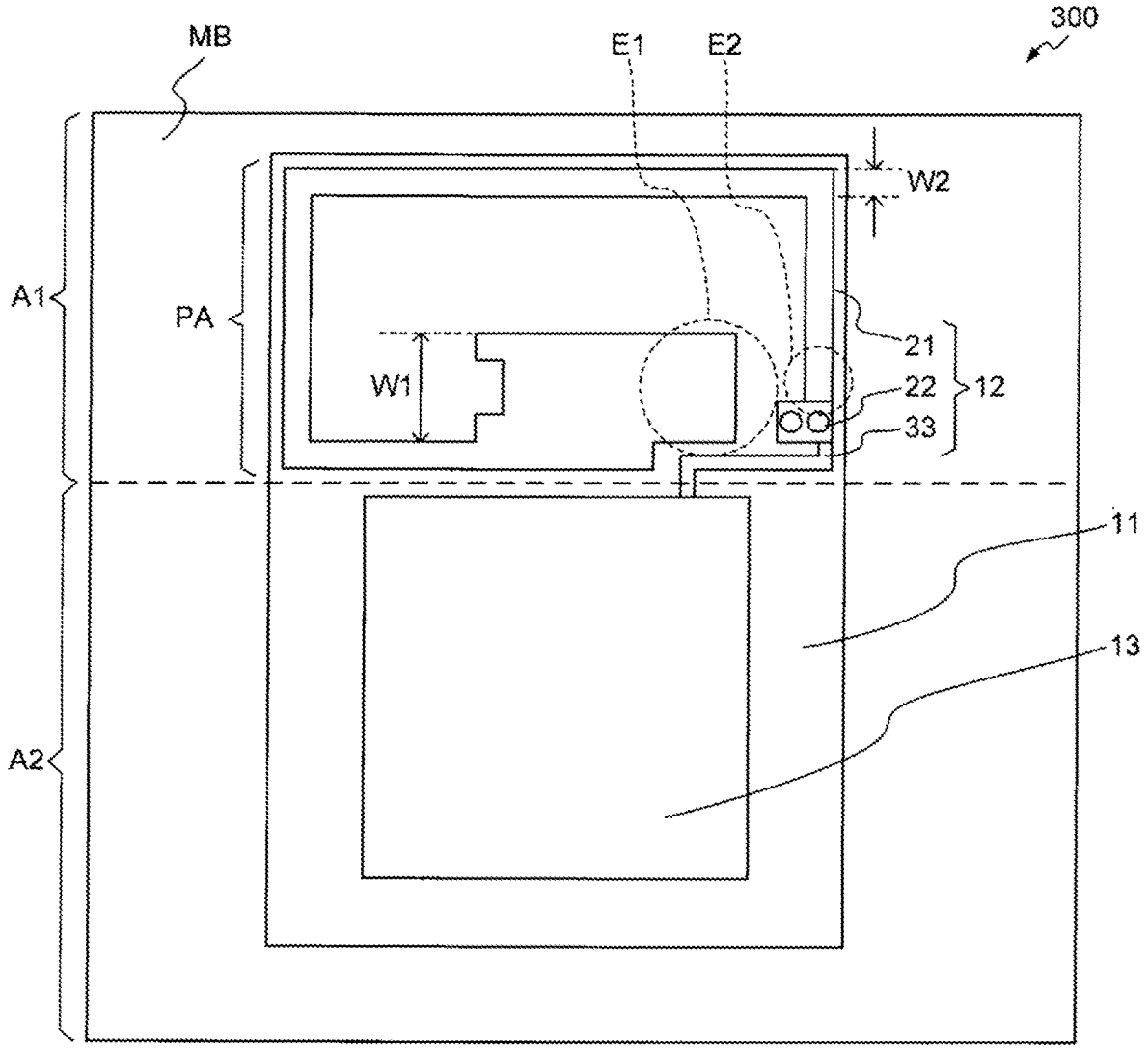
FIG. 6 is a top view showing a configuration of a wireless module according to Embodiment 2 of the present invention.

FIG. 6 is a top diagram showing a wireless module 300 of Embodiment 2. The wireless module 300 of the present embodiment differs from the wireless module 100 of Embodiment 1 in that, in the wireless module 300, the conductor unit 21 and the short-circuit line 33 are formed in different conductive layers from each other.

The conductor unit 21 is formed in the L2 layer, which is the second conductive layer, among the plurality of conductive layers of the multilayer substrate 11 shown in FIG. 2. Meanwhile, the short-circuit line 33 is formed in the L3 layer, which is the third conductive layer. The conductor unit 21 and the short-circuit line 33 are connected to each other through a via (not shown) that connects the L2 layer to the L3 layer, the via being disposed in the feed port 22.

Also, in a top view of the antenna 12, or in other words, the view from a direction perpendicular to the plane formed by the loop of the conductor unit 21 (hereinafter referred to as the "loop plane"), the conductor unit 21 and the short-circuit line 33 are formed at non-overlapping positions (non-intersecting positions).

Currents in opposite directions, respectively, flow through the conductor unit 21 and the short-circuit line 33. However, as described above, in the wireless module 300 of the present embodiment, the conductor unit 21 and the short-circuit line 33 are formed in differing conductive layers in positions that do not overlap each other in a top view. Thus, mutual canceling out of currents between the current flowing in the conductor unit 21 and the current flowing in the short-circuit line 33 is further reduced.

Therefore, according to the wireless module 300 of the present embodiment, it is possible to improve the radiation efficiency of the antenna.

The present invention is not limited to the embodiments above. In the embodiment above, for example, a case was described in which the resonant frequency is 2.4 GHz. However, the resonant frequency is not limited to this frequency band, and any frequency band may be used as long as the resonant frequency of the inverted-F antenna is the same as the resonant frequency of the split-ring resonator.

Also, in the embodiment above, a case was described in which the multilayer substrate 11 is a four-layer rigid substrate, but the configuration of the multilayer substrate 11 is not limited thereto. For example, the multilayer substrate 11 may be constituted of a ceramic substrate or a flexible substrate. Also, a two-layer structure or a six-layer structure may be used instead of the four-layer structure. That is, the multilayer substrate 11 need only be a multilayer substrate with at least two conductive layers.

Also, the shape of the conductor unit 21 is not limited to the embodiments above. For example, in Embodiment 1, a case was described in which the second end of the conductor unit 21 has a rectangular shape with a width W1, but the configuration is not limited thereto, and a shape may be used in which the width W1 gradually increases. Regarding the shape of the antenna 12 of the present embodiment, the greater the width W1 of the second end of the conductor unit 21 is, the greater the capacitance ("C" in FIG. 3B) of the split-ring resonator is. Also, the shorter the distance is between the first end E2 and the second end E1 constituting the open end section of the conductor unit 21, the greater the capacitance of the split-ring resonator can be made.

In Embodiment 2, a case was described in which the entire conductor unit 21 of the antenna 12 is formed in a different conductive layer than the short-circuit line 33. However, the entire conductor unit 21 need not be formed in a different layer as long as the region of a portion including at least the second end E1 is formed in a different conductive layer than the short-circuit line 33. For example, a configuration may be adopted in which only the region in the vicinity of the second end E1 of the conductor unit 21 is formed in the L2 layer, and another region connected by a via is formed in the L3 layer.

Also, the conductor unit 21 may be formed across a plurality of the conductive layers sandwiching the dielectric layers PP (e.g., the L1 layer and the L2 layer, and the L3 layer and the L4 layer). According to this configuration, the capacitance C of the split-ring resonator can be increased. Thus, it is possible to adjust the capacitance C of the split-ring resonator by selecting whether to pass through the dielectric layers PP using a via, in addition to the width of the second end E1 of the conductor unit 21 and the distance between the first end E2 and the second end E1.

What is claimed is:

1. A wireless module, comprising:

a multilayer substrate;

an element installation section formed in a substrate plane of the multilayer substrate; and an antenna including a conductor unit formed in an antenna disposal region in the substrate plane of the multilayer substrate, the conductor unit having a first end and a second end that extend along an outer periphery of the antenna disposal region and that are separated from each other in a direction of said extension, the conductor unit being formed in a loop as seen from a direction perpendicular to a substrate surface of the multilayer substrate, a feed unit that is connected to the first end of the conductor unit and is configured to receive input of an AC signal of a prescribed frequency, and a short-circuit line having a first end connected to a ground and a second end connected to the conductor unit through the feed unit.

2. The wireless module according to claim 1, wherein the antenna is formed as an inverted-F antenna of the prescribed frequency where the conductor unit is a main body portion, and is formed as a split-ring resonator that is configured such that a capacitance is formed between the first end and the second end and such that a resonant frequency of the split-ring resonator is the prescribed frequency.

3. The wireless module according to claim 1, wherein the multilayer substrate includes at least two conductive layers, wherein a region in at least a portion of one conductive layer of the multilayer substrate includes the second end of the conductor unit, and wherein the short-circuit line is formed in another conductive layer of the multilayer substrate.

4. The wireless module according to claim 3, wherein the conductor unit and the short-circuit line are formed in different conductive layers sandwiching a core of the multilayer substrate.

5. The wireless module according to claim 3, wherein the region in at least the portion of the one conductive layer of the multilayer substrate including the second end of the conductor unit is formed in a position not overlapping the short-circuit line when viewed from the direction perpendicular to the substrate surface of the multilayer substrate.

6. The wireless module according to claim 1, wherein a region in at least a portion of one conductive layer of the multilayer substrate including the second end of the conductor unit has a conductor width greater than a width of the first end.

7. A wireless module, comprising:

a multilayer substrate;

a circuit unit configured to transmit and receive wireless signals, the circuit unit being formed in an element installation region in a substrate plane of the multilayer substrate; and an antenna including a conductor unit formed in an antenna disposal region of the multilayer substrate, the conductor unit having a first end and a second end that extend along an outer periphery of the antenna disposal region and that are separated from each other in a direction of said extension, and the conductor unit being formed in a loop as seen from a direction perpendicular to a substrate surface of the multilayer substrate, a feed unit that is connected to the first end of the conductor unit and is configured to receive input of an AC signal of a prescribed frequency from the communication circuit, and a short-circuit line having a first end connected to a ground and a second end connected to the conductor unit through the feed unit.

* * * * *